US005105543A

United States Patent [19]

Maarschalk et al.

[11] Patent Number: 5,105,543

[45] Date of Patent: Apr. 21, 1992

[54] RESCUE CUTTING TOOL

[75] Inventors: A. J. Maarschalk, Heemstede; M. Smink, Haarlem, both of Netherlands

[73] Assignee: Code 3 Res Q Equipment, Inc., St. Louis, Mo.

[21] Appl. No.: 592,226

[22] Filed: Oct. 3, 1990

[51] Int. Cl.[5] ..... B26B 15/00; B26B 13/26; B26B 17/00

[52] U.S. Cl. ..... 30/228; 30/135; 30/180

[58] Field of Search ..... 30/134, 180, 223, 227, 30/228, 229, 135; 83/607, 609

[56] References Cited

U.S. PATENT DOCUMENTS

| | | | |
|---|---|---|---|
| 1,507,529 | 9/1924 | Sundman | 30/227 |
| 2,490,086 | 12/1949 | Page | 30/228 |
| 2,652,626 | 9/1953 | Dutcher | 30/228 |
| 4,791,726 | 12/1988 | Ailey Jr. | 30/180 |
| 4,903,408 | 2/1990 | Tagawa | 30/228 |
| 4,967,474 | 11/1990 | Wells | 30/180 |

FOREIGN PATENT DOCUMENTS

| | | | |
|---|---|---|---|
| 1223942 | 6/1960 | France | 30/180 |

*Primary Examiner*—Douglas D. Watts
*Assistant Examiner*—Paul M. Heyrana, Sr.
*Attorney, Agent, or Firm*—Senniger, Powers, Leavitt & Roedel

[57] ABSTRACT

A power operated portable cutting tool for rescue work. A cutting head comprises first and second jaw members, each jaw member having a cutting edge portion adjacent one end and a shank portion adjacent the other end. The jaw members are pivotally attached together about an axis of pivot generally intermediate their ends so that the cutting edge portions are generally opposing, and so that pivoting the shank portions apart pivots the cutting edge portions of the jaw members closed. A hydraulic cylinder and piston are mounted between the shank portions of the jaw members along an axis generally transverse to the axis of pivot of the jaw members. A handle connects the tool to a hydraulic fluid supply line and to a hydraulic fluid return line. Hydraulic fluid is selectively applied to the cylinder to extend the piston and close the jaw members. The jaw members are spring biased to retract the piston and open the jaw members.

27 Claims, 5 Drawing Sheets 112
114
116
118
120
122

RESCUE CUTTING TOOL

BACKGROUND OF THE INVENTION

This invention relates to rescue tools of the type used at the scene of an accident to free trapped victims, and particularly to a portable hydraulically powered cutting tool.

Cutting tools and other types of emergency tools are often needed at the scene of an automobile accident or other disaster in order to free trapped victims or to give access to an area. Examples of these types of tools can be found in U.S. Pat. Nos. 3,837,076, 3,819,153, 3,891,187, 4,197,706, 4,273,311, 4,333,330, 4,392,263, 4,506,445, 4,522,054, 4,531,289, 4,732,029, 4,789,139, 4,482,249, and Re. 33,002.

These prior art rescue tools suffer from a number of problems and disadvantages. First, the prior art cutting tools were generally large and hard to manipulate. This was particularly a problem in cramped spaces, for example, when trying to cut a brake or clutch pedal to free the driver from a wrecked vehicle. The prior art cutting tools also tend to propel the cut pieces with a great deal of force, which could cause injury to the victim or to the rescue worker. The prior art cutting tools also had a very fast cutting action. While it is important to release the victim as soon as possible, the fast action of the tools made them difficult to control. Finally, the prior art cutting tools were often difficult to operate.

SUMMARY OF THE INVENTION

It is among the objects of the present invention to provide a compact and easy to manipulate cutting tool for use in rescue operations; to provide such a cutting tool that smoothly and evenly cuts through materials without propelling the cut pieces with great force; to provide such a cutting tool that has a slow and deliberate cutting action for better control; and to provide such a cutting tool that is of simple construction and easy to operate.

The cutting tool of this invention is particularly adapted for rescue work. Generally, the tool comprises a cutting head comprising first and second jaw members. Each jaw member has a cutting edge portion adjacent one end and a shank portion adjacent the other end. The jaw members are pivotally attached together about an axis of pivot, generally intermediate their ends, so that the cutting edge portions are generally opposing, and so that pivoting the shank portions apart pivots the cutting edge portions of the jaw members closed. A hydraulic cylinder and piston are pivotally mounted between the shank portions of the jaw members, so that the cutting head pivots about the axis of the cylinder.

A handle extends generally transversely from the axis of the cylinder. The handle includes means for connecting the tool to a hydraulic fluid supply line and to a hydraulic fluid return line. The handle also includes means for selectively supplying hydraulic fluid under pressure to the cylinder to extend the piston and close the jaw members. The tool comprises some means, for example springs, for biasing the jaw members open.

In the preferred embodiment the end of the cylinder is pivotally mounted to the shank portion of one of the jaw members along an axis generally transverse to the axis of pivot. A link extends between the piston and the shank portion of the other of the jaw members. One end of the link is connected to the piston with a ball and socket joint, and the other end of the link is connected to the shank portion of the jaw member with a ball and socket joint.

The means for selectively supplying hydraulic fluid under pressure comprises a chamber in the handle having a forward end in communication with the cylinder, and a rearward end, and means for selectively connecting the rearward end of the chamber to the hydraulic fluid supply line and to the hydraulic fluid return line. There is a shuttle in the chamber. The shuttle has forward and rearward ends and a generally axial passage for hydraulic fluid extending between the forward and rearward ends. The passage includes one-way valve means that only permits flow through the passage from the rearward end toward the forward end. The shuttle member is resiliently biased toward the forward end of the chamber. Sealing means is provided to seal the forward end of the shuttle member with the forward end of the chamber so that when the rearward end of the chamber is connected to the hydraulic fluid supply line, hydraulic fluid can flow into the chamber, through the passage in the shuttle, though the first end of the chamber to the cylinder to move the piston and thereby close the jaw members. The shuttle is movable against the forward bias so that when the rearward end of the chamber is connected to the hydraulic fluid return line, the biasing force on the jaw members forces the hydraulic fluid from the cylinder, forcing the shuttle member rearwardly in the chamber so that hydraulic fluid flows from the cylinder, around the shuttle, through the rearward end of the chamber.

The means for selectively connecting the rearward end of the chamber to the hydraulic fluid supply line and to the hydraulic fluid return line preferably comprises a body in the handle having a bore therein. There is at least one inlet port, connected to the hydraulic fluid supply line, and opening to the bore, and at least one outlet port, connected to the hydraulic fluid return line, and opening to the bore at a location axially spaced from the inlet port. A hollow tubular valve member is rotatably mounted in the bore in the body. The valve member has inlet openings in general axial alignment with the inlet port, and outlet openings in general axial alignment with the outlet port. The valve member is rotatable between a neutral position, a high pressure position, and a low pressure position. The inlet and outlet openings are positioned around the circumference of the valve member so that (1) when the valve member is in the neutral position the inlet openings communicate with the inlet ports and the outlet openings communicate with the outlet port, (2) when the valve member is in the high pressure position the inlet openings communicate with the inlet port but the outlet openings do not communicate with the outlet port; and (3) when the valve member is in the low pressure position the inlet openings do not communicate with the inlet port but the outlet openings communicate with the outlet port.

The cutting edges of the jaw members are convexly curved. The cutting edge of at least one of the jaw members has notches therein for reducing the tendency of the jaws to push out the article being cut.

Thus, the cutting tool of the present invention is compact and easy to manipulate. The cutting head freely pivots so that the cutting jaws can be easily manipulated to make the desired cuts, even in tight spaces. The convexly curved configuration of the cutting edges, and the notches in the cutting edges allow the cutting tool to smoothly and evenly cuts through materials without propelling the cut pieces with great force. The controls for the device are very simple and easy to operate. The tool provides a slow and deliberate cutting action for better control. These and other features and advantages will be in part apparent and in part pointed out hereinafter.

BRIEF DESCRIPTION OF THE DRAWINGS

Corresponding reference numerals indicate corresponding parts throughout the drawings.

DETAILED DESCRIPTION OF THE PREFERRED EMBODIMENT

Figure 1:
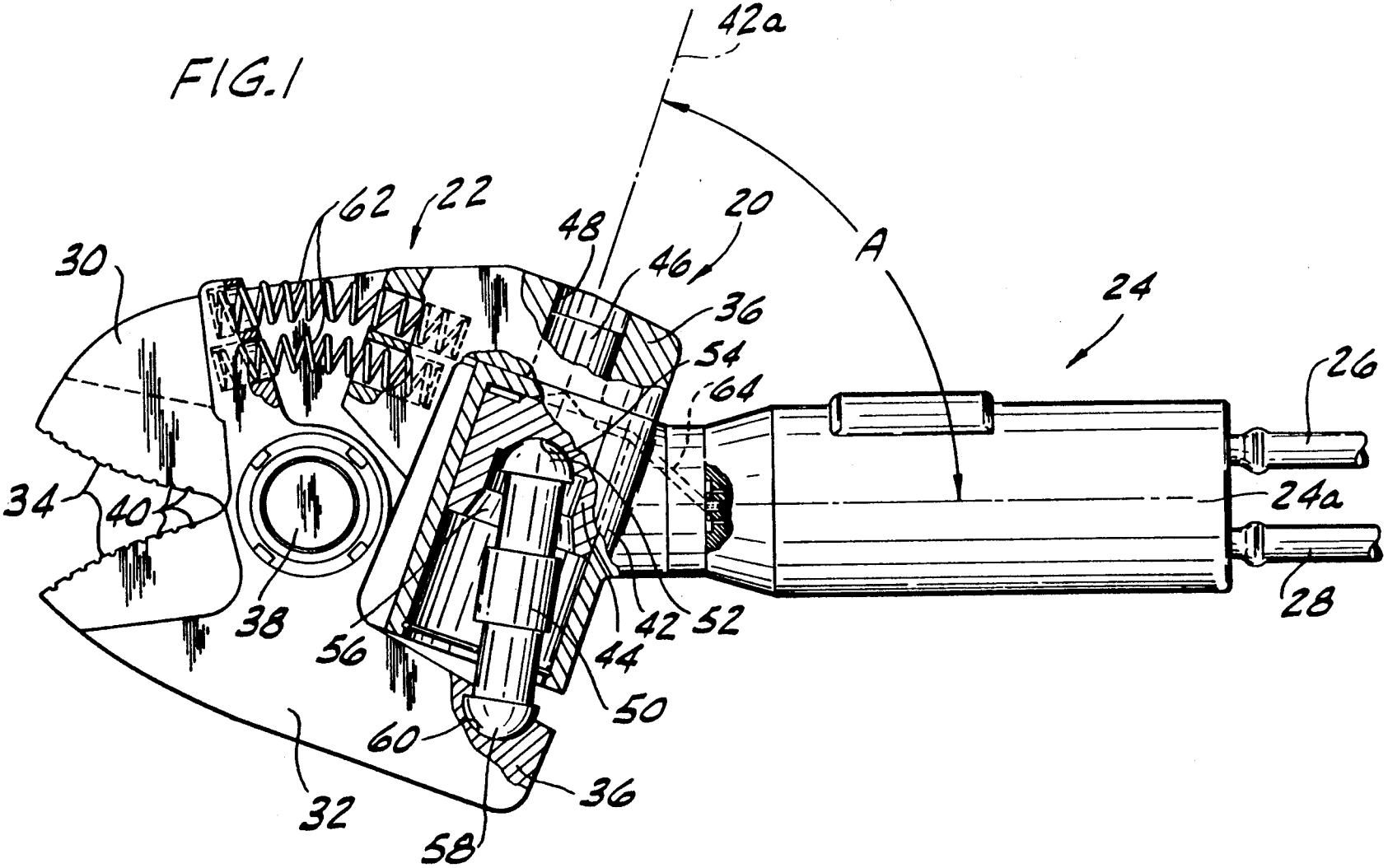
FIG. 1 is a top plan view of a rescue cutting tool constructed according to the principles of this invention in the open position, with portions broken away to show details of construction.

A rescue cutting tool constructed according to the principles of this invention is indicated generally as 20 in FIG. 1. The rescue cutting tool 20 comprises a cutting head 22 and a handle 24. The handle 24 is adapted to be connected to a hydraulic fluid supply line 26 for supplying hydraulic fluid under pressure from a pump or other suitable source, and to a hydraulic fluid return line 28 returning hydraulic fluid to the source. The supply line 26 is at a relatively higher pressure than the return line 28.

The cutting head 22 comprises first and second jaw members 30 and 32. Each of the jaw members 30 and 32, has a cutting edge portion 34 adjacent one end and a shank portion 36 adjacent the other end. The jaw members 30 and 32 are pivotally attached together at 38, generally intermediate their ends so that their cutting edge portions 34 are generally opposing, and so that pivoting the shank portions 36 apart pivots the cutting edge portions 34 of the jaw members closed. The cutting edge portions 34 are preferably convexly curved. This configuration of the cutting edge portions has been found to smoothly and evenly cut through objects, without propelling the cut object, thereby reducing the risk of injury to the victim or to the rescuer. One of both of the cutting edge portions 34 may be provided with notches 40 which help prevent object being cut from slipping from between the cutting edge portions 34.

Figure 2:
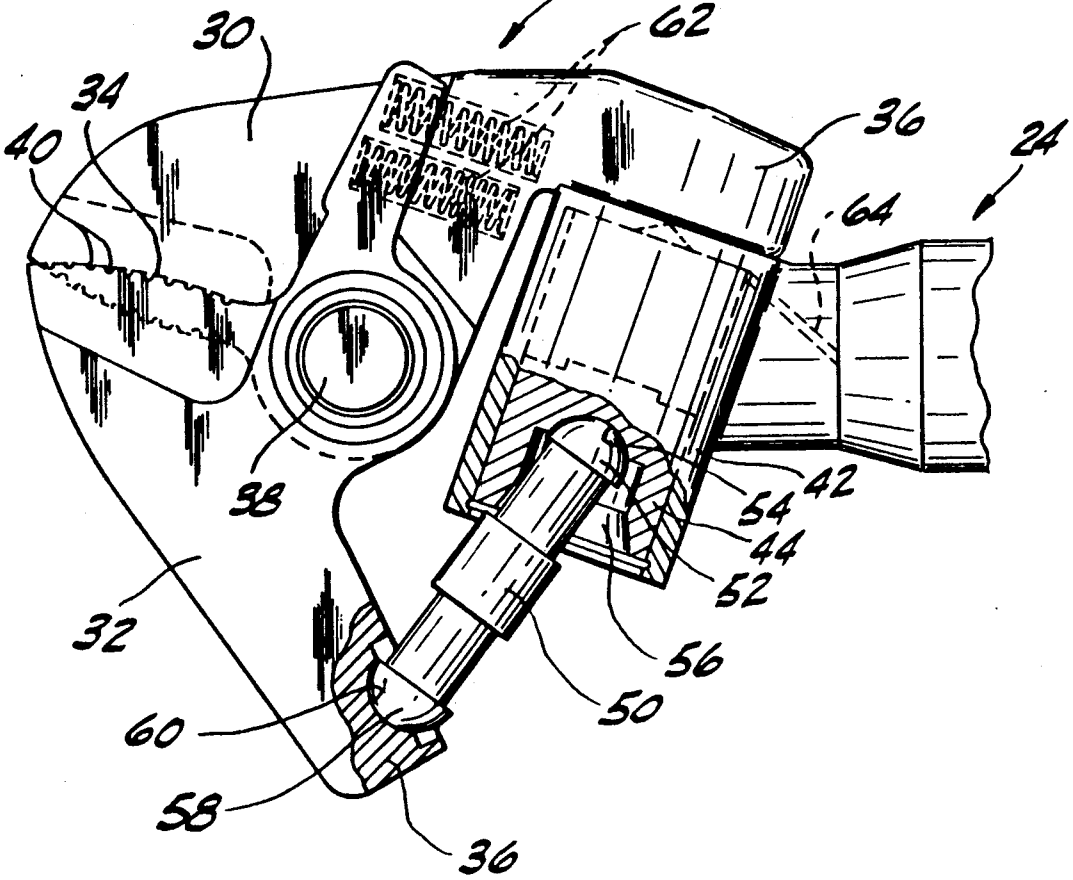
FIG. 2 is a top plan view of the cutting head of the rescue cutting tool in the closed position.
Figure 3:
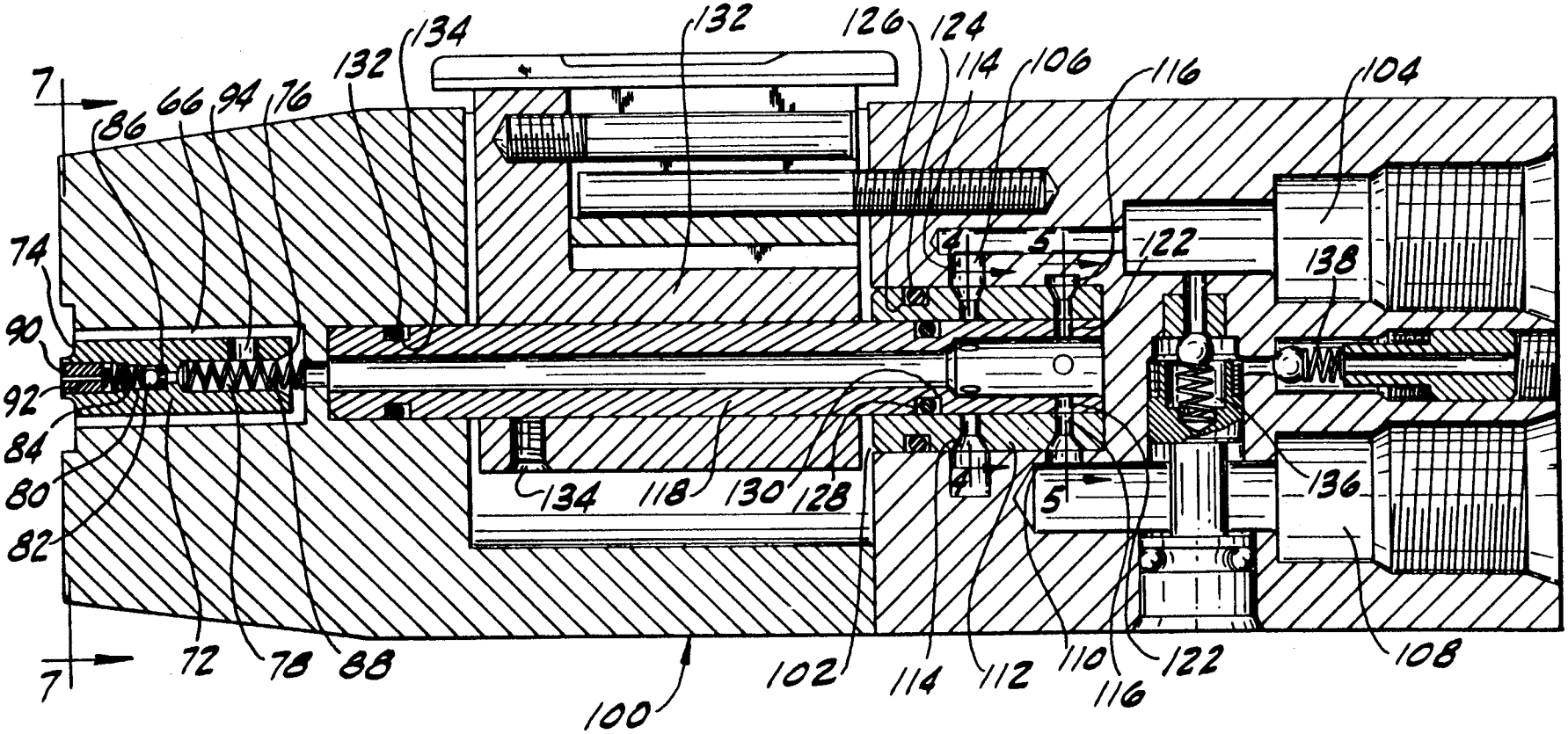
FIG. 3 is an enlarged longitudinal cross-sectional view of the handle of the rescue cutting tool.

A hydraulic cylinder 42 and piston 44 are pivotally mounted between the shank portions 36 of the jaw members 30 and 32, so that the cutting head 22 pivots about the axis of the cylinder 42. The bottom of the cylinder 42 has a cylindrical boss 46 projecting therefrom which is journaled in an opening 48 in the shank portion 36 of the jaw member 30. A link member 50 extends between the piston 44 and the shank portion 36 of the other jaw member 32. The connection between the link member 50 and the piston 44 and jaw member 32 allows the cutting head 22 to pivot relative to the cylinder 42 about axis **42*a*. This pivoting action of the cutting head 22 allows the tool to be easily manipulated to the proper cutting site, even in confined areas. The connection between the link member 50 and the piston 44 is preferably a ball-and-socket type joint, with the link member 50 having a generally hemispherical head 52 received in a hemispherical socket 54 in the piston 44. The end 56 of the piston 44 is open to accommodate the motion of the link 50 as the piston moves in the cylinder (compare FIGS. 1 and 2). Similarly, the connection between the link member 50 and the jaw member 32 is preferably a ball-and-socket type joint, with the link member 50 having a generally hemispherical head 58 received in a hemispherical socket 60 in the jaw member 32**.

The tool 20 also include some means for biasing the jaw members open. This means may comprise at least one, and preferably two coil springs 62 between the jaw members 30 and 32.

The handle 24 extends generally transversely from the axis of the cylinder 42. The axis of the handle **24*a* is preferably oriented at an angle A of at least 20° and not more than 80° with respect to the axis of the cylinder 42*a*. The handle 24 includes means for selectively applying hydraulic fluid under pressure to the cylinder 42 to extend the piston 44 and close the jaw members 30 and 32, and for selectively applying hydraulic fluid under low pressure to allow the piston to retract under the bias of the springs 62 which open the jaw members 30 and 32. A passage 64 extends between the handle 24 and the bottom of the cylinder 42**, for conducting hydraulic fluid to and from the cylinder.

As best shown in FIGS. 3 and 6A–6C, the means for selectively applying hydraulic fluid may comprise a chamber 66 having a forward end 68 in communication with the passage 64 (and thus the cylinder 42), and a rearward end 70. The selective applying means also includes means for selectively connecting the rearward end of the chamber 66 to the hydraulic fluid supply line 26 so that the chamber is at a relatively high pressure, or to the hydraulic fluid return line 28 so the chamber is at a relatively low pressure. In this preferred embodiment, the selective connecting means also allows the rearward end of the chamber 66 to be connected to both the fluid supply line 26 and the fluid return line 28 so that the chamber is at an intermediate pressure between the high pressure and the low pressure.

There is a shuttle 72 in the chamber 66. The shuttle 72 has a forward end 74, and a rearward end 76. The shuttle 72 has a generally axial passage 78 extending between the forward end 74 and rearward end 76. The passage 78 includes one-way valve means, such as a ball and spring check valve 80 (comprising ball 82 and spring 84 which urges the ball 82 against an O-ring seat 86), that only permits hydraulic fluid to flow forwardly through the passage 78, from the rearward end 76 toward the forward end 74. Means, for example spring 88, which extends into the rearward end of the passage 78, biases the shuttle 72 toward the forward end 68 of the chamber 66. The forward end of the passage 78 has a plug 90 therein with an axial throttling passage 92 therein for metering the flow of hydraulic fluid through the passage 78, as described below. The passage 78 also connects with an opening 94 in the side of the shuttle 72, generally in the rearward portion of the shuttle.

The forward end 74 of the shuttle 72 has means, such as gasket 95, for sealing the forward end of the shuttle with the forward end 68 of the chamber 66 so that when hydraulic fluid under relatively high pressure is applied to the rearward end 70 of the chamber 66, hydraulic fluid can flow into the chamber 66, and then through the passage 78 in the shuttle 72, and out the forward end 74 of the shuttle into the passage 64 to move the piston 44 and thereby close the jaw members 30 and 32. (See FIG. 6A) The shuttle 72 is movable against the bias of the spring 88 so that when relatively low pressure is applied to the rearward end 70 of the chamber 66, the hydraulic fluid can be forced from the cylinder 42, thereby forcing the shuttle 72 rearwardly in the chamber 66 so that hydraulic fluid flows from the cylinder 42, around the shuttle 72, through the chamber 66, and out the rearward end 70 of the chamber. (See FIG. 6C).

Figure 7:
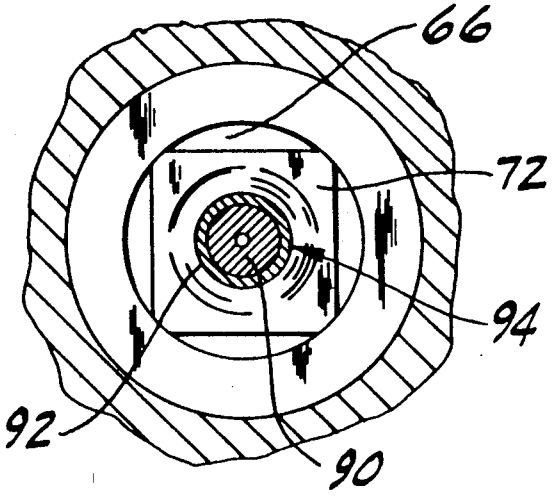
FIG. 7 is an enlarged transverse cross-sectional view of the handle taken along the plane of line 7—7 in FIG. 3.

As best shown in FIG. 7, the chamber 66 has a generally circular transverse cross-section, and the shuttle member 72 has a generally square cross-section. As shown in FIG. 7 the corners of the cross-section of the shuttle member 72 are rounded to slide smoothly in the chamber 66.

The means for selectively connecting the rearward end 70 of the chamber 66 to the hydraulic fluid supply line 26 and to the hydraulic fluid return line 28 comprises a body 100 (for example the handle 24) having an axial bore 102 therein. (See FIG. 3). The body 100 has an inlet 104 connected to the hydraulic fluid supply line 26. The inlet 104 opens to an annulus 106 surrounding the rearward end of the bore 102. The body 100 also has an outlet 108 connected to the hydraulic fluid return line 28. The outlet 108 opens to an annulus 110 that surrounds the rearward end of the bore 102, but is axially spaced rearwardly of the annulus 106. A sleeve 112 is seated in the rearward end of the bore 102. The sleeve 112 has a set of four inlet ports 114 equally spaced about the circumference of the sleeve 112, in communication with the annulus 106. The sleeve 112 also has a set of four outlet ports 116 equally spaced about the circumference of the sleeve 112, axially spaced from the inlet ports, and in communication with the annulus 110.

Figures 4A, 4B, 4C, 5A, 5B, 5C:
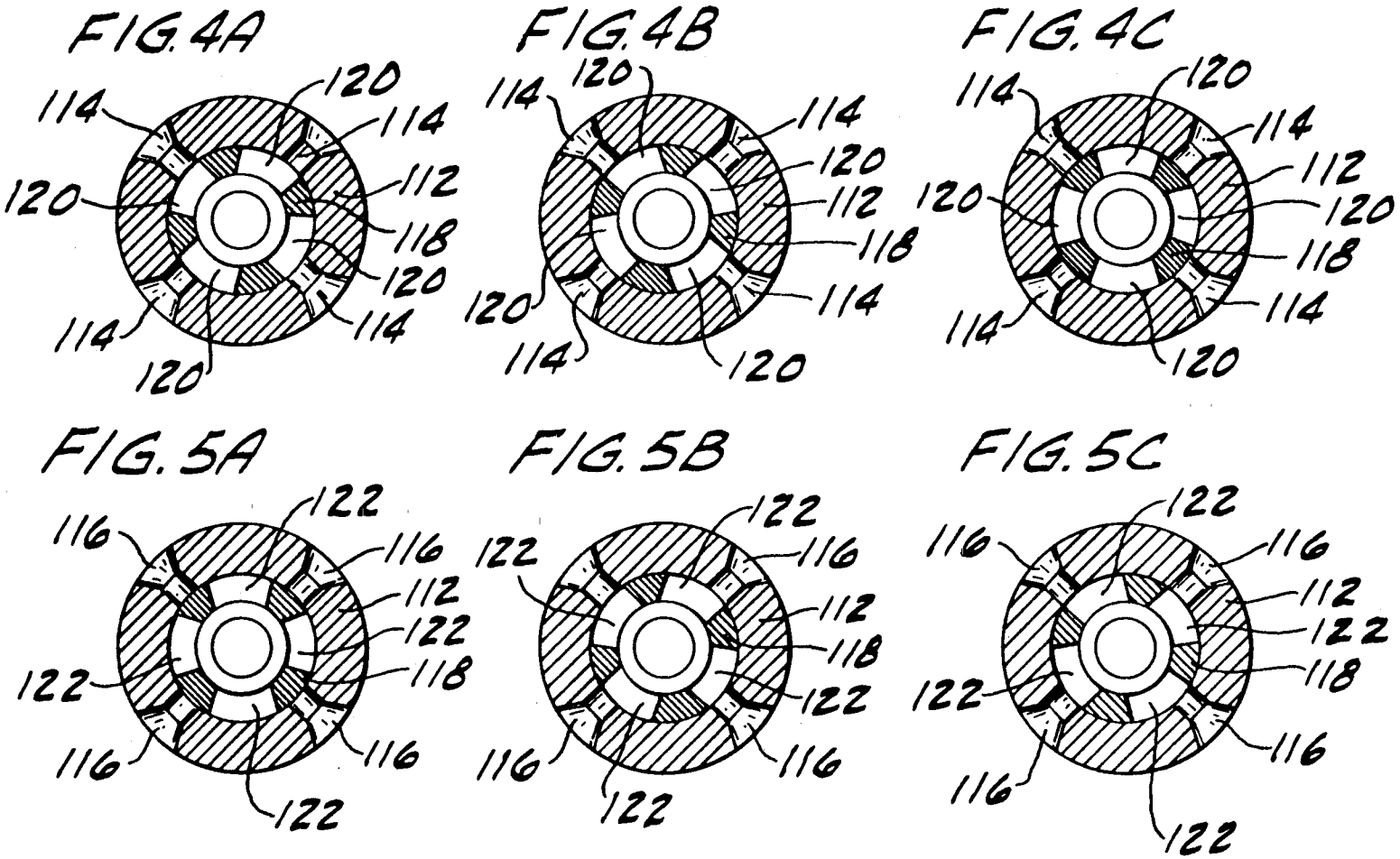
FIG. 4A is a transverse cross-sectional view of the handle, taken along the plane of line 4—4 in FIG. 3, when the tool is in its high pressure or cutting mode.
FIG. 4B is a transverse cross-sectional view of the handle, taken along the plane of line 4—4 in FIG. 3, when the tool is in its neutral or idle mode.
FIG. 4C is a transverse cross-sectional view of the handle, taken along the plane of line 4—4 in FIG. 3, when the tool is in its low pressure or release mode.
FIG. 5A is a transverse cross-sectional view of the handle, taken along the plane of line 5—5 in FIG. 3, when the tool is in its high pressure or cutting mode.
FIG. 5B is a transverse cross-sectional view of the handle, taken along the plane of line 5—5 in FIG. 3, when the tool is in its neutral or idle mode.
FIG. 5C is a transverse cross-sectional view of the handle, taken along the plane of line 5—5 in FIG. 3, when the tool is in its low pressure or release mode.

A hollow, tubular valve member 118 is rotatably mounted in the sleeve 112. The valve member 118 has a set of inlet openings 120 equally spaced about the circumference of the valve member 118. The inlet openings 120 are in general axial alignment with the inlet ports 114. The valve member 118 also has a set of outlet openings 122, axially spaced from the inlet openings 120. The outlet openings 122 are generally axially aligned with the outlet ports 116. The positions of the inlet openings 120 are circumferentially offset from the positions of the outlet openings 122 so that the valve member 118 has three positions with respect to the sleeve 112: a high pressure position (FIGS. 4A and 5A), a neutral position (FIGS. 4B and 5B), and a low pressure position (FIGS. 4C and 5C). (Alternatively, the inlet ports 114 and the outlet ports 116 could be circumferentially offset from each other).

The forward end of the valve member 118 communicates with the rearward end of the chamber 66. The sleeve 112 is sealed in the rearward end of the bore 102, for example with an O-ring 124 in an annular groove 126 in the sleeve 112. The rearward end of the valve member 118 is sealed in the sleeve 112, for example with an O-ring 128 in an annular groove 130 in valve member 118. The forward end of the valve member 118 is sealed in the forward end of the bore 102, for example with an O-ring 132 in an annular groove 134.

As best shown in FIGS. 4A and 5A, in the high pressure position the inlet openings 120 in the valve member 118 are aligned with the inlet ports 114 in the sleeve 112, but the outlet openings 122 in the valve member 118 are not aligned with outlet ports 116 in the sleeve 112, resulting in hydraulic fluid under relatively high pressure being applied to the rearward end 70 of the chamber 66 via valve member 118. This pressure is in excess of about 20 bars. As best shown in FIGS. 4B and 5B, in the neutral position the inlet openings 120 in the valve member 118 are aligned with the inlet ports 114 in the sleeve 112, and the outlet openings 122 in the valve member 118 are aligned with the outlet ports 116 in the sleeve 112, so that hydraulic fluid under pressure from the hydraulic fluid supply line 26 is connected to the hydraulic fluid return line 28, resulting in a moderate pressure being applied to the rearward end 70 of the chamber 66 via valve member 118. This pressure is on the order of about 20 bars. As best shown in FIGS. 4C and 5C, in the low pressure position, the inlet openings 120 in the valve member 118 are not aligned with the inlet ports 114 in the sleeve 112, but the outlet openings 122 in the valve member 118 are aligned with the outlet ports 116 in the sleeve 112, resulting in relatively low pressure being applied to the rearward end 70 of the chamber 66 via valve member 118. This pressure is less than about 20 bars.

The valve member 118 extends through a passage in a switch member 132. The switch member 132 is secured to the valve member, for example with set screw 134. Movement of the switch member 132 causes the valve member 118 to rotate among the high pressure, neutral, and low pressure positions. The valve member 118 is resiliently biased to the neutral position. Only a small amount of movement of switch member 132 is needed to move the valve member among the various positions.

A first by-pass check valve 136 extends between the inlet 104 and the outlet 108, to allow hydraulic fluid to pass from the hydraulic fluid supply line 26 to the hydraulic fluid return 28, if the pressure differential reaches a predetermined maximum determined by the valve 136. A second by-pass check valve 138 extends between the first by-pass check valve 136 and the exterior of the tool to allow hydraulic fluid to escape to the atmosphere if the pressure reaches a predetermined maximum determined by the valve 138.

OPERATION

Figure 6A:
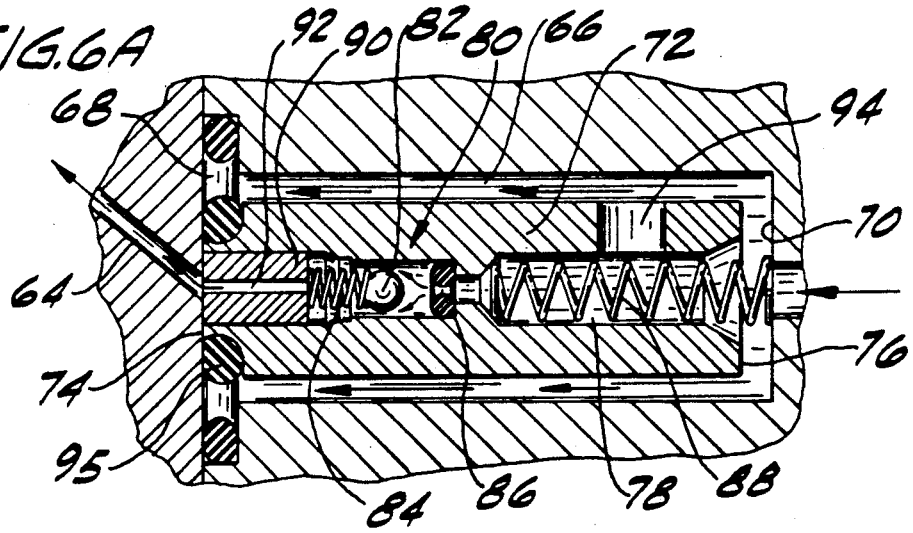
FIG. 6A is an enlarged longitudinal cross-sectional view of the handle, when the tool is in its cutting mode.

In operation the cutting jaws are positioned around the object to be cut, for example stem of a brake pedal. The switch member 132 is moved, for example with the thumb, to move the valve member 118 to the high pressure position. This movement causes the inlet openings 120 in the valve member 118 to remain aligned with the inlet ports 114 in the sleeve 112, but causes the outlet openings 122 in the valve member 118 to become misaligned with the outlet ports 116 in the sleeve 112. Hydraulic fluid from the hydraulic fluid supply line 26 under relative high pressure is applied to the rearward end 70 of the chamber 66. The hydraulic fluid passes through the valve member 118 to the chamber 66. As shown in FIG. 6A, the high pressure hydraulic fluid can flow through the passage 78, through the check valve 80, through the throttling passage 92 in the plug 90, through the passage 64 to cylinder 42 where it urges piston 44 outwardly, closing the jaw members 30 and 32. The throttling passage 92 limits the flow of hydraulic fluid, causing the jaw members to close in a slow, controlled manner.

Figure 6B:
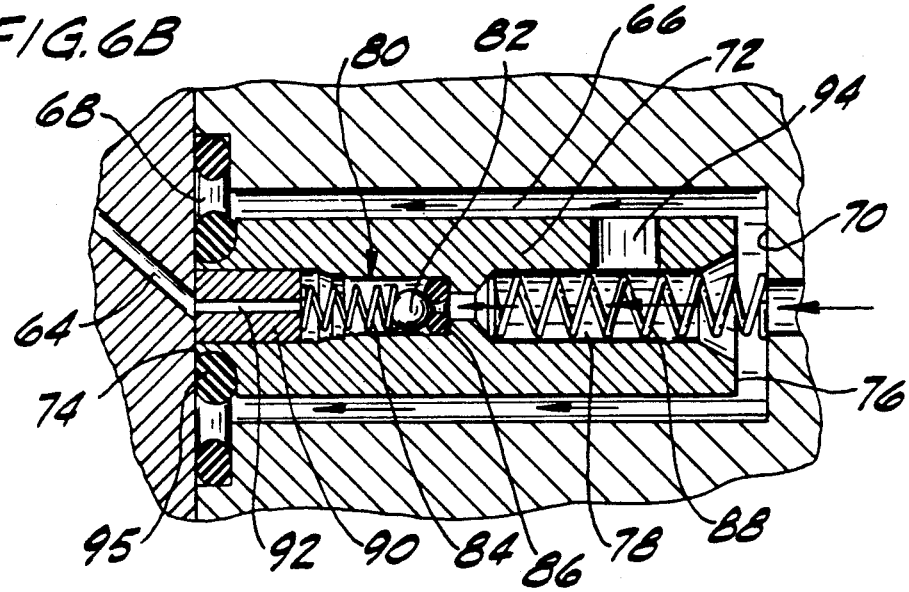
FIG. 6B is an enlarged longitudinal cross-sectional view of the handle, when the tool is in its idle mode.

Once the jaw members 30 and 32 are closed, the switch member 132 is released and the valve member 118 returns to the neutral position. The inlet openings 120 in the valve member 118 remain aligned with the inlet ports 114 in the sleeve 112, and the outlet openings 122 in the valve member 118 become aligned with the outlet ports 116 in the sleeve 112. Hydraulic fluid at moderate pressure is applied to the rearward end 70 of the chamber 66. The hydraulic fluid under high pressure short circuits from the inlet 104 to the outlet 108, so the pressure of the fluid in the chamber 66 is intermediate the pressure in high pressure and the low pressure positions. Because the pressure in the chamber 66 has dropped (from the high pressure), as shown in FIG. 6B the check valve 80 in the passage 78 closes, however there is adequate pressure so that together with the spring 88, the shuttle 72 is still is held in place against the forward end 68 of the chamber 66.

Figure 6C:
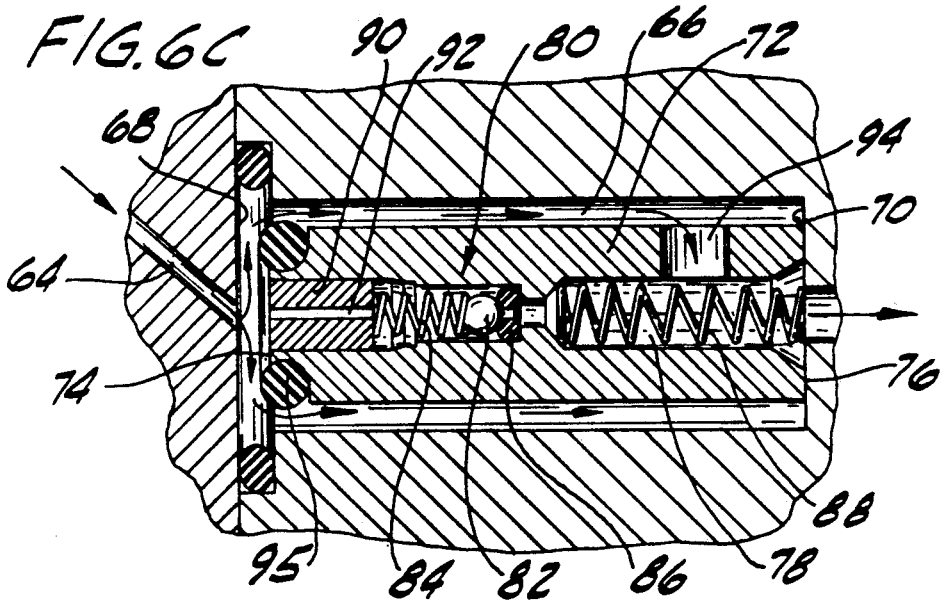
FIG. 6C is an enlarged longitudinal cross-sectional view of the handle, when the tool is in its release mode.

When it is desired to open the jaw members, the switch member 132 is moved, for example with the thumb, to the low pressure position. The inlet openings 120 in the valve member 118 become misaligned with the inlet ports 114 in the sleeve 112, but the outlet openings 122 in the valve member 118 remain aligned with the outlet ports 116 in the sleeve 112. The source of high pressure fluid is thus cut off, and hydraulic fluid at low pressure is applied to rearward end 70 of the chamber 66. The pressure in the chamber 66 drops further (from the neutral pressure). The force of the springs 62 forces the jaw members 30 and 32 open, which in turn forces hydraulic fluid out of the cylinder 42, through the passage 64. As shown in FIG. 6C, this forces the shuttle 72 rearwardly in the chamber 66. The fluid flows around the shuttle member 72, through the chamber 66, through opening 94 in the shuttle member, and then through the passage 78 and out of the chamber 66. The hydraulic fluid then passes out the hydraulic fluid return line 28.

When the jaws are opened, the switch member 132 is released and it returns to the neutral position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A power operated portable cutting tool for rescue work, the tool comprising:

a cutting head comprising first and second jaw members, each jaw member having a cutting edge portion adjacent one end and a shank portion adjacent the other end, the jaw members being pivotally attached together about an axis of pivot generally intermediate their ends so that the cutting edge portions are generally opposing, and so that pivoting the shank portions apart pivots the cutting edge portions of the jaw members closed;

a hydraulic cylinder and piston mounted between the shank portions of the jaw members along an axis generally transverse to the axis of pivot of the jaw members, said first jaw member being attached to the cylinder and the second jaw member being attached to the piston;

a handle connected to the cylinder and including means for connecting the tool to a hydraulic fluid supply line and to a hydraulic fluid return line, and means for selectively applying hydraulic fluid to the cylinder to extend the piston and close the jaw members by pivoting the cutting edge of the second jaw member toward the cutting edge portion of the first jaw member and to allow the piston to retract and open the jaw members by pivoting the cutting edge portion of the second jaw member away from the cutting edge portion of the first jaw member; and wherein the cylinder and piston are pivotally mounted between the shank portions of the jaw members, so that the cutting head pivots about the axis of the cylinder and so that the cutting head pivots generally transversely to the handle and generally transversely to the axis of pivot of the jaw members.

2. The tool according to claim 1 wherein the handle extends generally transversely from the axis of the cylinder.

3. The tool according to claim 1 wherein the handle extends generally transversely from the axis of the cylinder defining an angle of at least 20 degrees and not more than 80 degrees between the axis of the cylinder and the axis of the handle.

4. The tool according to claim 1 further comprising means for biasing the jaw members open.

5. The tool according to claim 4 wherein the biasing means comprises at least one spring between the jaw members.

6. The tool according to claim 5 wherein the handle includes a passage supplying fluid to fill the cylinder thereby moving the piston to close the cutting edge portions of the jaw members and wherein the action of the spring opens the cutting edge portions of the jaw members so that the piston retracts forcing fluid out of the cylinder.

7. The tool according to claim 1 wherein one end of the cylinder is pivotally mounted in the shank portion of one of the jaw members, and further comprising a link, extending between the piston and the shank portion of the other of the jaw members.

8. The tool according to claim 7 wherein one end of the link is connected to the piston with a ball and socket joint, and wherein the other end of the link is connected to the shank portion of the jaw member with a ball and socket joint.

9. The tool according to claim 1 further comprising throttling means which meters the flow of hydraulic fluid in the cylinder so that the jaw members close slowly but which is bypassed when hydraulic fluid flows out of the cylinder.

10. The tool according to claim 1 wherein the selectively applying means includes means for bypassing the cylinder and connecting the hydraulic fluid supply line to the hydraulic fluid return line.

11. The tool according to claim 1 wherein the cutting edges of the jaw members are convexly curved.

12. The tool according to claim 11 wherein the cutting edge of at least one of the jaw members has notches therein for reducing the tendency of the jaws to push out the article being cut.

13. A power operated portable cutting tool for rescue work, the tool comprising:

a cutting head comprising first and second jaw members, each jaw member having a cutting edge portion adjacent one end and a shank portion adjacent the other end, the jaw members being pivotally attached together about an axis of pivot generally intermediate their ends so that the cutting edge portions are generally opposing, and so that pivoting the shank portions apart pivots the cutting edge portions of the jaw members closed;

a hydraulic cylinder and piston mounted between the shank portions of the jaw members along an axis generally transverse to the axis of pivot of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members; wherein the means for selectively applying hydraulic fluid comprises:

a chamber having a forward end in communication with the cylinder, and a rearward end;

means for selectively connecting the rearward end of the chamber to hydraulic fluid under high pressure and to hydraulic fluid under low pressure;

a shuttle in the chamber, the shuttle having forward and rearward ends and a generally axial passage for hydraulic fluid extending between the forward and rearward ends, the passage including one-way valve means that only permits flow through the passage from the rearward end toward the forward end;

means for biasing the shuttle member toward the forward end of the chamber; and means for sealing the forward end of the shuttle member with the forward end of the chamber so that when the rearward end of the chamber is connected to high pressure hydraulic fluid, hydraulic fluid can flow into the chamber, through the passage in the shuttle, through the first end of the chamber to the cylinder to move the piston and thereby close the jaw members, the shuttle being movable against the bias of the biasing means so that when the rearward end of the chamber is connected to low pressure hydraulic fluid, the pressure of the hydraulic fluid in the cylinder forces the shuttle member rearwardly in the chamber so that hydraulic fluid flows from the cylinder, around the shuttle and through the chamber, and out the rearward end of the chamber.

14. The tool according to claim 13 wherein the chamber has a generally circular transverse cross-section, and wherein the shuttle member has a generally square cross-section.

15. The tool according to claim 13 wherein the means for selectively connecting the rearward end of the chamber to hydraulic fluid under high pressure and to hydraulic under low pressure comprises a body having a bore therein; at least one inlet port connected to a hydraulic fluid supply line and opening to the bore; at least one outlet port connected to a hydraulic fluid return line and opening to the bore at a location axially spaced from the inlet port; a hollow tubular valve member rotatable in the bore in the body, the valve member first openings in general axial alignment with the inlet port and second openings in general axial alignment with the outlet port, the valve member being rotatable between a neutral position, a high pressure position, and a low pressure position, the first and second openings being positioned around the circumference of the valve member so that when the valve member is in the neutral position the first openings communicate with the inlet port and the second opening communicate with the outlet port, when the valve member is in the high pressure position the first openings communicate with the inlet port but the second openings do not communicate with the outlet port; and when the valve member is in the low pressure position the first openings do not communicate with the inlet port but the second openings do communicate with the outlet port.

16. The tool according to claim 13, wherein the passage in the shuttle comprises throttling means which meters the flow of hydraulic fluid into the cylinder so that the jaw members close slowly, and which is bypassed when hydraulic fluid flows out of the cylinder.

17. A power operated portable cutting tool for rescue work, the tool comprising:

a cutting head comprising first and second jaw members, each jaw member having a convexly curved cutting edge portion adjacent one end and a shank portion, the jaw members being pivotally attached together about an axis of pivot so that the cutting edge portions are generally opposing, and so that pivoting the shank portions pivots the cutting edge portions of the jaw members closed;

a hydraulic cylinder and piston mounted to pivotally move the shank portions of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members; and wherein the cutting edge of at least one of the jaw members has notches therein for reducing the tendency of the jaws to push out the article being cut.

18. A power operated portable cutting tool for rescue work the tool comprising:

a cutting head comprising first and second jaw members, each jaw member having a cutting edge portion adjacent one end and a shank portion, the jaw members being pivotally attached together about an axis of pivot so that the cutting edge portions are generally opposing, and so that pivoting the shank portions pivots the cutting edge portions of the jaw members closed;

a hydraulic cylinder and piston mounted to pivotally move the shank portions of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members;

means for biasing the jaw members open wherein the handle includes a passage supplying fluid to fill the cylinder thereby moving the piston to close the cutting edge portions of the jaw members and wherein the action of the biasing means opens the cutting edge portions of the jaw members so that the piston retracts forcing fluid out of the cylinder.

19. A power operated portable cutting tool for rescue work, the tool comprising:

a cutting head comprising first and second jaw members, each jaw member having a cutting edge portion adjacent one end and a shank portion adjacent the other end, the jaw members being pivotally attached together about an axis of pivot generally intermediate their ends so that the cutting edge portions are generally opposing, and so that pivoting the shank portions apart pivots the cutting edge portions of the jaw members closed;

a hydraulic cylinder and piston mounted between the shank portions of the jaw members along an axis generally transverse to the axis of pivot of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members; and means for biasing the jaw members open.

20. The tool according to claim 19 further comprising throttling means which meters the flow of hydraulic fluid in the cylinder so that the jaw members close slowly but which is bypassed when hydraulic fluid flows out of the cylinder.

21. The tool according to claim 19 wherein the selectively applying means includes means for bypassing the cylinder and connecting the hydraulic fluid supply line to the hydraulic fluid return line.

22. A power operated portable cutting tool for rescue work, the tool comprising:

a cutting head comprising first and second jaw members, each jaw member having a cutting edge portion adjacent one end and a shank portion adjacent the other end, the jaw members being pivotally attached together about an axis of pivot generally intermediate their ends so that the cutting edge portions are generally opposing, and so that pivoting the shank portions apart pivots the cutting edge portions of the jaw members closed;

a hydraulic cylinder and piston mounted between the shank portions of the jaw members along an axis generally transverse to the axis of pivot of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members; and throttling means which meters the flow of hydraulic fluid in the cylinder so that the jaw members close slowly but which is bypassed when hydraulic fluid flows out of the cylinder.

23. The tool according to claim 22 further comprising means for biasing the jaw members open.

24. The tool according to claim 22 wherein the selectively applying means includes means for bypassing the cylinder and connecting the hydraulic fluid supply line to the hydraulic fluid return line.

25. A power operated portable cutting tool for rescue work, the tool comprising:

a cutting head comprising first and second jaw members, each jaw member having a cutting edge portion adjacent one end and a shank portion adjacent the other end, the jaw members being pivotally attached together about an axis of pivot generally intermediate their ends so that the cutting edge portions are generally opposing, and so that pivoting the shank portions apart pivots the cutting edge portions of the jaw members closed;

a hydraulic cylinder and piston mounted between the shank portions of the jaw members along an axis generally transverse to the axis of pivot of the jaw members;

a handle including means for connecting the tool to a hydraulic fluid supply line and to a hydraulic fluid return line, and means for selectively applying hydraulic fluid to the cylinder to extend the piston and close the jaw members and to allow the piston to retract and open the jaw members, wherein the selectively applying means includes means for bypassing the cylinder and connecting the hydraulic fluid supply line to the hydraulic fluid return line.

26. The tool according to claim 25 further comprising means for biasing the jaw members open.

27. The tool according to claim 25 further comprising throttling means which meters the flow of hydraulic fluid in the cylinder so that the jaw members close slowly but which is bypassed when hydraulic fluid flows out of the cylinder.

* * * * *